US009573398B2

(12) United States Patent
Sekino et al.

(10) Patent No.: US 9,573,398 B2
(45) Date of Patent: Feb. 21, 2017

(54) CARRIAGE ASSEMBLY AND HEAD POSITION ADJUSTMENT MECHANISM

(71) Applicant: CANON KABUSHIKI KAISHA, Tokyo (JP)

(72) Inventors: Takeshi Sekino, Yokohama (JP); Koichi Kudaki, Kawasaki (JP); Ryoma Arai, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/731,482

(22) Filed: Jun. 5, 2015

(65) Prior Publication Data

US 2015/0352868 A1 Dec. 10, 2015

(30) Foreign Application Priority Data

Jun. 10, 2014 (JP) ..... 2014-119640

(51) Int. Cl.
*B41J 25/34* (2006.01)

(52) U.S. Cl.
CPC ..... *B41J 25/34* (2013.01)

(58) Field of Classification Search
CPC ..... B41J 25/34; B41J 25/308; B41J 25/3082; B41J 25/3086
USPC ..... 347/37
See application file for complete search history.

(56) References Cited

U.S. PATENT DOCUMENTS 4,595,931 A 6/1986 Toganoh et al.
4,642,654 A 2/1987 Toganoh et al.
4,733,247 A 3/1988 Arai et al.
5,984,466 A 11/1999 Nagashima et al.
6,789,966 B2 * 9/2004 Tanaka ..... B41J 19/00 347/198
6,974,203 B2 * 12/2005 Ikeda ..... B41J 19/00 347/37
7,537,312 B2 5/2009 Sekino et al.
7,566,108 B2 7/2009 Nojima et al.
(Continued)

FOREIGN PATENT DOCUMENTS

EP 2591918 A1 5/2013
JP 2004-268340 A 9/2004
(Continued)

OTHER PUBLICATIONS

Chinese Office Action dated Jun. 2, 2016 in Chinese Application No. 201510313106.1.

*Primary Examiner* — Justin Seo
*Assistant Examiner* — Michael Konczal
(74) *Attorney, Agent, or Firm* — Fitzpatrick, Cella, Harper & Scinto

(57) ABSTRACT

The present invention provides a mechanism that improves accuracy for positioning a head relative to a carriage, and easily performs positional adjustment for the head. A carriage unit includes a first carriage structure and a second carriage structure. The first carriage structure includes a first sliding face that can slide along a guide shaft, and a head can be mounted on the first carriage structure. The second carriage structure includes a second sliding face that can slide along the guide shaft, and can hold the first carriage structure to allow positional adjustment for the first carriage structure in a predetermined direction in which a position where the first sliding face contacts the guide shaft is to be shifted.

10 Claims, 16 Drawing Sheets

(56) References Cited

U.S. PATENT DOCUMENTS

| | | | | |
|---|---|---|---|---|
| 7,753,480 | B2 * | 7/2010 | Ueda | B41J 19/00 347/37 |
| 8,146,529 | B2 | 4/2012 | Hakamata et al. | |
| 8,220,411 | B2 | 7/2012 | Yoshino et al. | |
| 8,348,401 | B2 | 1/2013 | Sekino et al. | |
| 8,465,124 | B2 * | 6/2013 | Hanaoka | B41J 19/20 347/37 |
| 8,789,491 | B2 | 7/2014 | Nagahara et al. | |
| 8,939,527 | B2 | 1/2015 | Shinohara et al. | |
| 8,960,859 | B2 | 2/2015 | Sekino | |
| 2007/0229590 | A1 | 10/2007 | Kadota et al. | |
| 2008/0007593 | A1 * | 1/2008 | Buonerba | B41J 25/3082 347/37 |
| 2009/0309922 | A1 | 12/2009 | Iwakura | |
| 2013/0113862 | A1 * | 5/2013 | Kemma | B41J 25/3082 347/37 |
| 2014/0009518 | A1 | 1/2014 | Kumagai et al. | |

FOREIGN PATENT DOCUMENTS

| | | | |
|---|---|---|---|
| JP | 2008-238785 | A | 10/2008 |
| JP | 2009-96029 | A | 5/2009 |

* cited by examiner

CARRIAGE ASSEMBLY AND HEAD POSITION ADJUSTMENT MECHANISM

BACKGROUND OF THE INVENTION

Field of the Invention

The present invention relates to a carriage assembly for use in (applied for), for example, a printing apparatus that prints images, while moving a carriage on which a head is mounted.

Description of the Related Art

A serial scan type printing apparatus prints images on sheets, while reciprocally moving a carriage on which a print head is mounted. The carriage is guided along a guide member to be capable of reciprocating in the main scanning direction. In order to improve the quality of an image printed by the printing apparatus, it is important that the print head should be appropriately positioned with respect to the sheet. For example, in a case wherein sheets having a different thickness are employed to print images, the position of the print head opposite a print face of the sheet should be adjusted in accordance with the thickness of the sheet, and an appropriate distance should be set between the print head and the sheet that faces the print head. In the present invention, this distance will be called a "gap".

In order to adjust the gap, an arrangement described in Japanese Patent Laid-Open No. 2004-268340 employs a carriage provided by assembling two structures. One of the two structures includes a bearing that can be reciprocally guided along a guide member arranged in the main body of a printing apparatus, while the other structure is provided to mount a print head on, and is attached to the previously mentioned structure through a position adjustment mechanism in a manner such that position adjustment can be performed. The position adjustment mechanism adjusts the position of the latter structure, with respect to the former structure, and sets a gap between the print head and a sheet.

According to the arrangement described in Japanese Patent Laid-Open No. 2004-268340, the print head is positioned, with respect to the guide member, by the structure guided by the guide member, the position adjustment mechanism, and the other structure. In the above described case wherein the print head is positioned, with respect to the guide member, by the two structures and the position adjustment mechanism, there is a possibility that the accuracy of positioning the print head will be degraded, and accordingly, the quality of a printed image will deteriorate.

SUMMARY OF THE INVENTION

The present invention provides a carriage assembly having a configuration that can improve the accuracy of positioning a head with respect to a carriage, and in which the position of the head can be easily adjusted.

In the first aspect of the present invention, there is provided a carriage assembly comprising:

a guide member; and a carriage configured to be moved along the guide member, with a head being mounted on the carriage, the carriage including (a) a first structure, which has a first sliding face that contacts the guide member, and on which the head is to be mounted, and (b) a second structure, which includes a second sliding face that contacts the guide member, and which holds the first structure to allow positional adjustment of the first structure, wherein a portion of the first sliding face that contacts the guide member is changed by performing the positional adjustment.

In the second aspect of the present invention, there is provided an apparatus comprising:

a carriage assembly in the first aspect of the present invention; and a conveying unit configured to convey a sheet, for which the head performs printing or scanning, in a direction crossing a direction in which the carriage assembly moves.

A carriage assembly according to the present invention includes a first structure and a second structure, wherein the position of the first structure, with respect to the second structure, can be adjusted. When the first structure on which a head is mounted is positioned directly relative to a guide member, the accuracy of positioning the head can be increased, and the position of the head (e.g., a gap between the head and the sheet) can be easily adjusted.

Further features of the present invention will become apparent from the following description of exemplary embodiments (with reference to the attached drawings).

DESCRIPTION OF THE EMBODIMENTS

Figure 1:
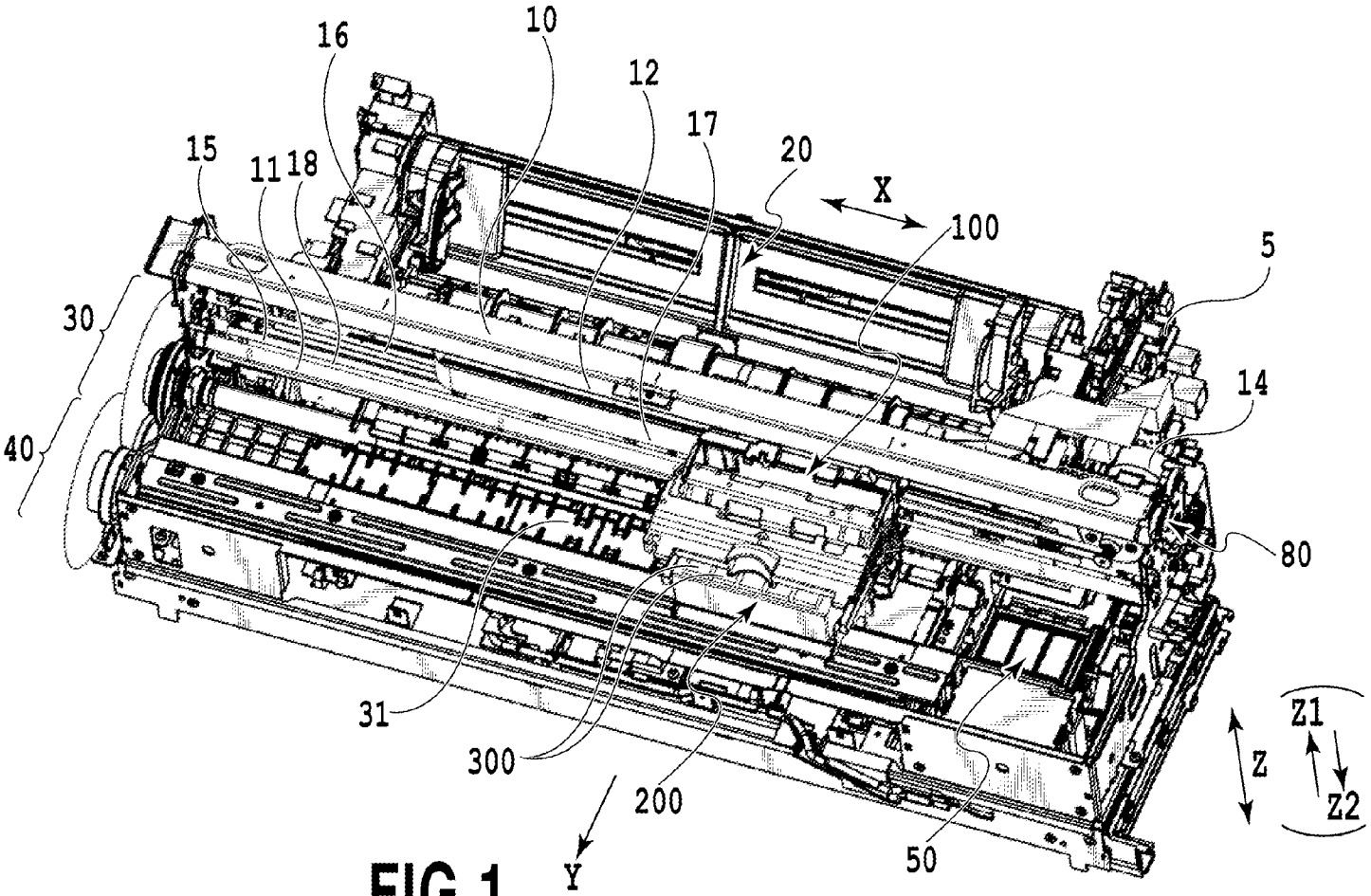
FIG. 1 is a perspective view of the inside of a printing apparatus according to one embodiment of the present invention.

A printing apparatus in an embodiment of the present invention is a serial scan type ink jet printing apparatus wherein an ink jet print head, that can eject ink, is mounted on a carriage that is to be moved in a main scanning direction. Images are printed in a serial scanning manner by moving the carriage in the main scanning direction.

(General Configuration of the Printing Apparatus)

The configuration of the printing apparatus is roughly divided into a feeding unit (ASF unit) 20, a conveying unit (sheet conveying unit) 30, a discharging unit 40, a print head recovery section (recovery unit) 50 and a carriage 100 that moves with a print head 200 being mounted on it.

The carriage 100 is provided as a carriage assembly that includes a first carriage structure and a second carriage structure that will be described later. Hereinafter, the carriage assembly is also called a carriage unit 100.

As will be described later, an ejection portion that can eject ink is provided for the print head 200. The printing apparatus stores, in a controller (not shown) on a control board 5, print data, for example, transmitted from a host apparatus (not shown), and starts a printing operation based on a printing start command issued by the controller.

In the printing operation, first, a print sheet P is supplied by the feeding unit 20 as a medium on which an image is to be printed. Based on information associated with the print sheet P that has been transmitted from the host apparatus, a lift driver 80 adjusts a distance (hereinafter also called a "gap") between the ejection portion of the print head 200 and the print sheet P in a manner that will be described later.

Thereafter, when the carriage unit 100 is moved, one time, in the main scanning direction indicated by an arrow X, the ejection portion of the print head 200 ejects ink based on the print data for one line. The carriage unit 100 is guided by a guide shaft (guide member) 11, which is fixed to a chassis 10 that is a constituent of the main body of the printing apparatus, and a support rail 12 that is fixed to the upper portion of the chassis 10, so that the carriage unit 100 can reciprocate in the main scanning direction of the arrow X. The main scanning direction of the arrow X intersects (is perpendicular to, in this case) a direction indicated by an arrow Y, in which the print sheet P is to be conveyed. The carriage unit 100 receives a drive force of a carriage motor 14 through a carriage belt 16 extended between the carriage motor 14 and an idler pulley 15, and reciprocally moves along the guide shaft 11 in the main scanning direction.

When an image for one line has been printed, the print sheet P is conveyed (fed) along a platen 31, at a required distance, by the conveying unit (sheet conveying unit) 30. Printing of the image for one line and conveying of the print sheet Pare repetitiously performed in this manner, and an image is printed in the entire print area of the print sheet P.

Figure 3:
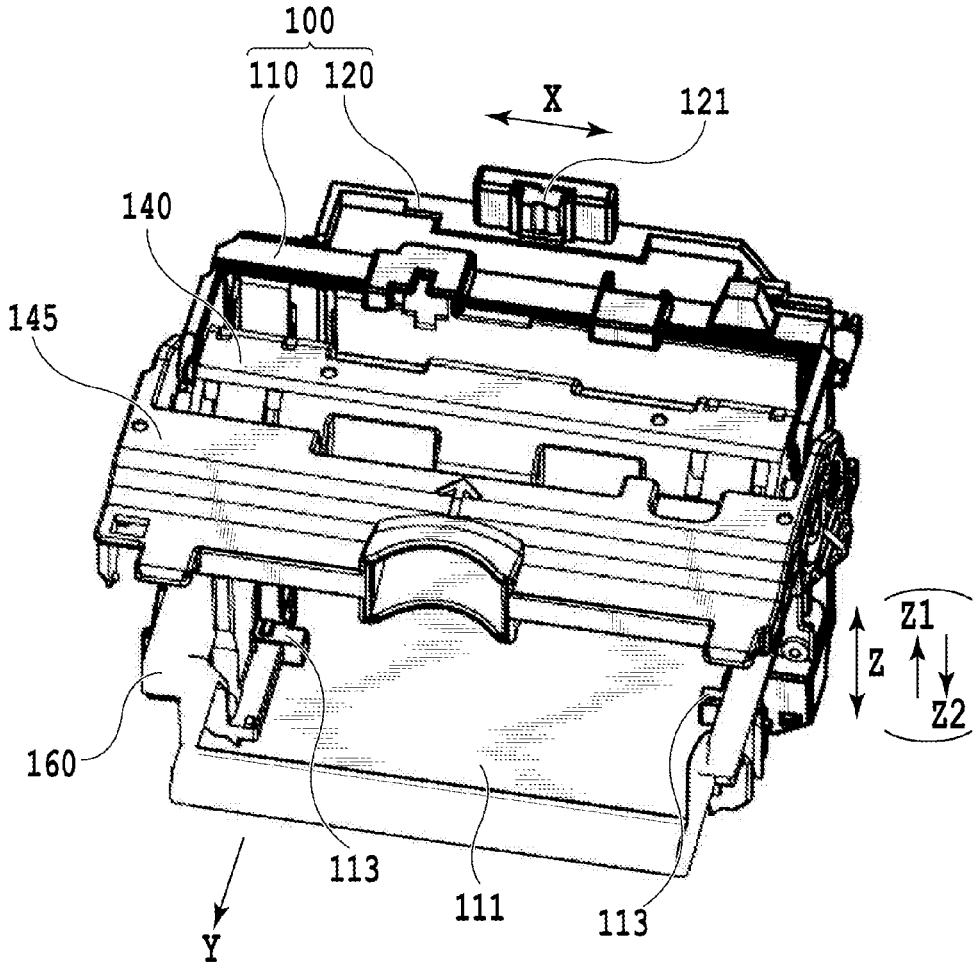
FIG. 3 is a perspective view of a carriage unit in FIG. 1.
Figure 4:
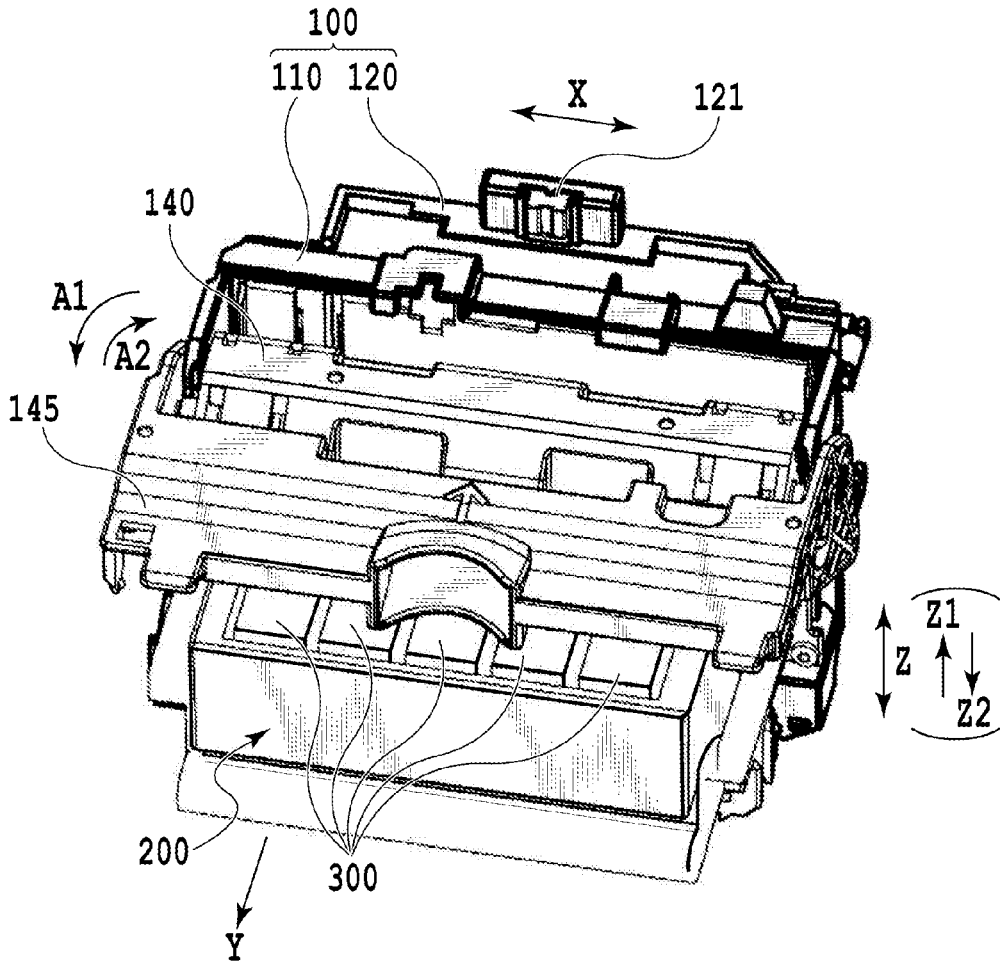
FIG. 4 is a perspective view of a carriage on which the print head is mounted.

As shown in FIG. 4, the carriage unit 100 includes a first carriage structure (also called a primary structure or a main carriage) 110 that moves in the main scanning direction with the print head 200 and an ink tank 300 being mainly mounted on. A second carriage structure (also called a secondary structure or a sub structure) is attached to a face (rear face) of the first carriage structure 110 close to the chassis 10, as shown in FIGS. 3 and 4. The carriage belt 16 is connected to the second carriage structure 120 to transmit a drive force of the carriage motor 14 to the carriage unit 100. The guide shaft 11 and the support rail 12 have a circular shape in cross section, and a bearing 105 (see FIG. 7) that slides against the guide shaft 11 is provided on each side of the carriage unit 100 in the main scanning direction. The bearings 105 will be described later.

A pressure contact connector (not shown) that can be electrically connected to the print head 200 is provided for the first carriage structure 110, on which the print head 200 can be mounted on. The pressure contact connector is pressed against a conductor exposing portion of a head board of the print head 200 by using elastic deformation of a plated metal, and is electrically connected to the print head 200. Further, the pressure contact connector is soldered to a carriage board (not shown) that is mounted on the first carriage structure 110. This carriage board is electrically connected through a flexible flat cable (FFC) 17 to the control board (control circuit) 5 in the main body of the printing apparatus.

When a signal is received from a head driver (not shown) through the FFC 17, the print head 200 can eject ink based on print data. Further, a CR encoder (not shown) on the carriage board reads markings on an encoder strip 18 extended along the chassis 10, and detects the movement position of the carriage unit 100. Based on the obtained detection results, the print head 200 ejects ink to the print sheet P at an appropriate timing.

Figure 2:
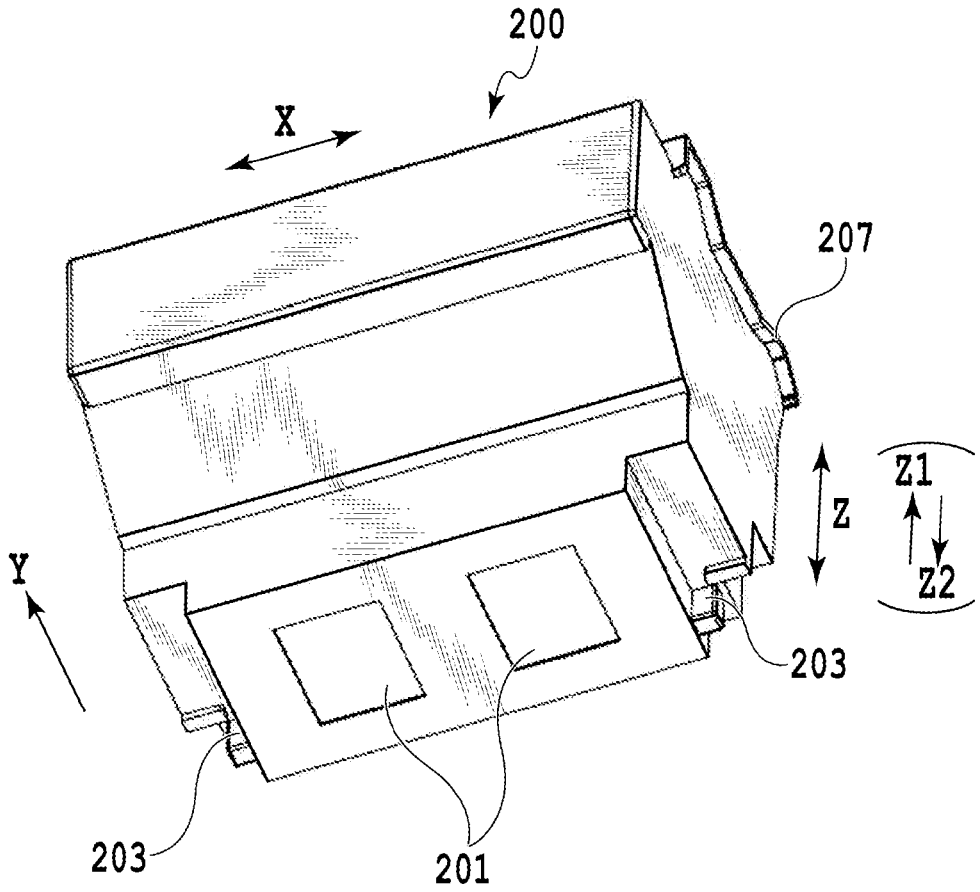
FIG. 2 is a schematic perspective view of a print head in FIG. 1.

FIG. 2 is a perspective view of the print head 200, obliquely viewed from the bottom, and an ejection portion 201 is formed on a lower face of the print head 200. An ink flow path that communicates with the ink tank 300 is formed for the ejection portion 201, so that when the print head 200 and the ink tank 300 are mounted on the first carriage structure 110 as shown in FIG. 4, ink in the ink tank 300 is to be introduced into the ejection portion 201. With this arrangement, ink stored in the ink tank 300 is supplied to the ejection portion 201.

A print head board (not shown) that can be electrically connected to the pressure contact connector of the first carriage structure 110 is provided on a side (the rear face) of the print head 200 upstream in the direction in which the print sheet P is to be conveyed. A conductor exposing portion (hereinafter also called a "contact face") for which resist deposition is not performed is formed on the print head board. Further, sixty contacts, for example, that can be electrically connected to the pressure contact connector of the first carriage structure 110 are arranged on the contact face. A plurality of ejection ports through which ink can be ejected are formed on the ejection portion 201 of the print head 200, and when ejection energy generating elements that correspond respectively to the ejection ports are selectively driven based on a print signal, ink can be ejected selectively from multiple ejection ports. Electrothermal transducing elements (heaters) or piezoelectric elements, for example, may be employed as ejection energy generating elements.

Two engagement portions 203 for print head positioning are arranged on the lower portion of the print head 200, as shown in FIG. 2, in order to hold the print head 200 in position in the first carriage structure 110. An X-directional (main scanning directional) abutting face is formed only on one side of each engagement portion 203 for print head positioning. Further, a Y abutting face used for print head positioning in a Y direction (conveying direction) and a Z abutting face used for print head positioning in upward and downward Z (Z1 and Z2) directions are formed on both lower sides of each engagement portion 203 for print head positioning. Further, a sub-abutting face (not shown) that abuts upon the first carriage structure 110 to position the print head 200 in the Y direction (conveying direction) is formed on the upper center of the rear face of the print head 200. Moreover, a sloped pressing face 207 to be locked by a head fixing portion 140 of the first carriage structure 110 that will be described later is arranged on the upper portion of the print head 200. When the sloped pressing face 207 is pushed down by the head fixing portion 140 of the first carriage structure 110 that will be described later, the print head 200 is positioned at a predetermined location.

(Arrangement of the Carriage Unit)

Figure 5:
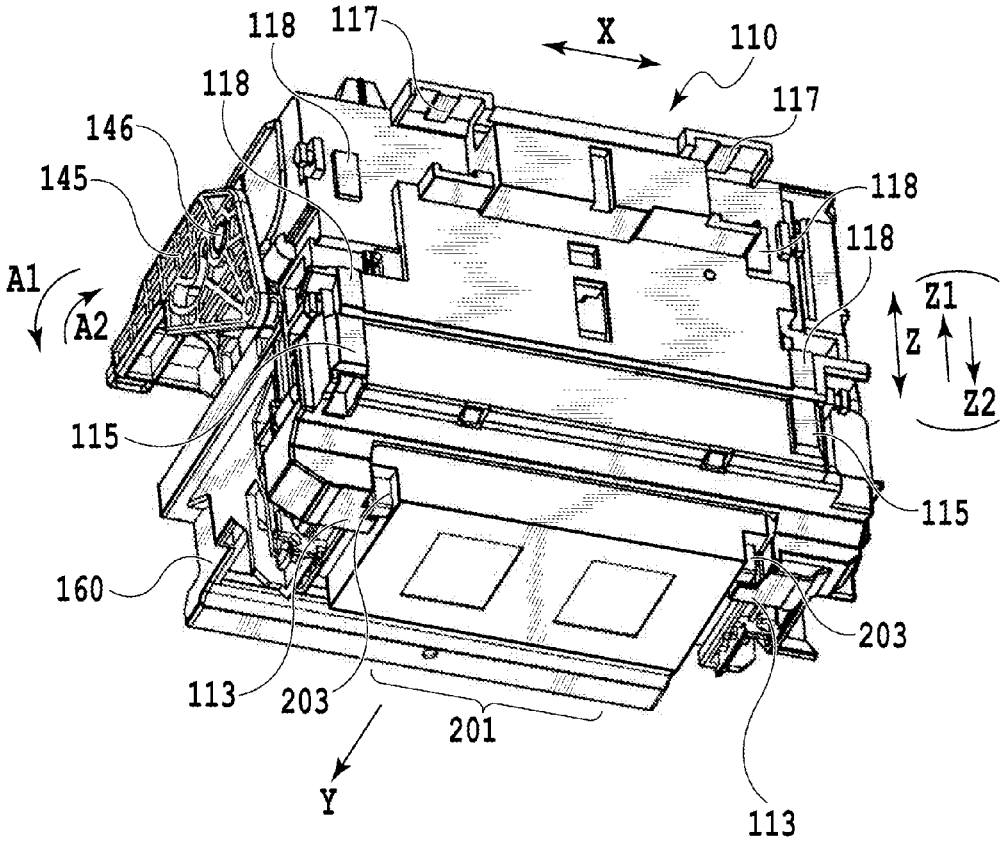
FIG. 5 is a rear perspective view of a first carriage structure that is a constituent of the carriage unit.
Figure 6:
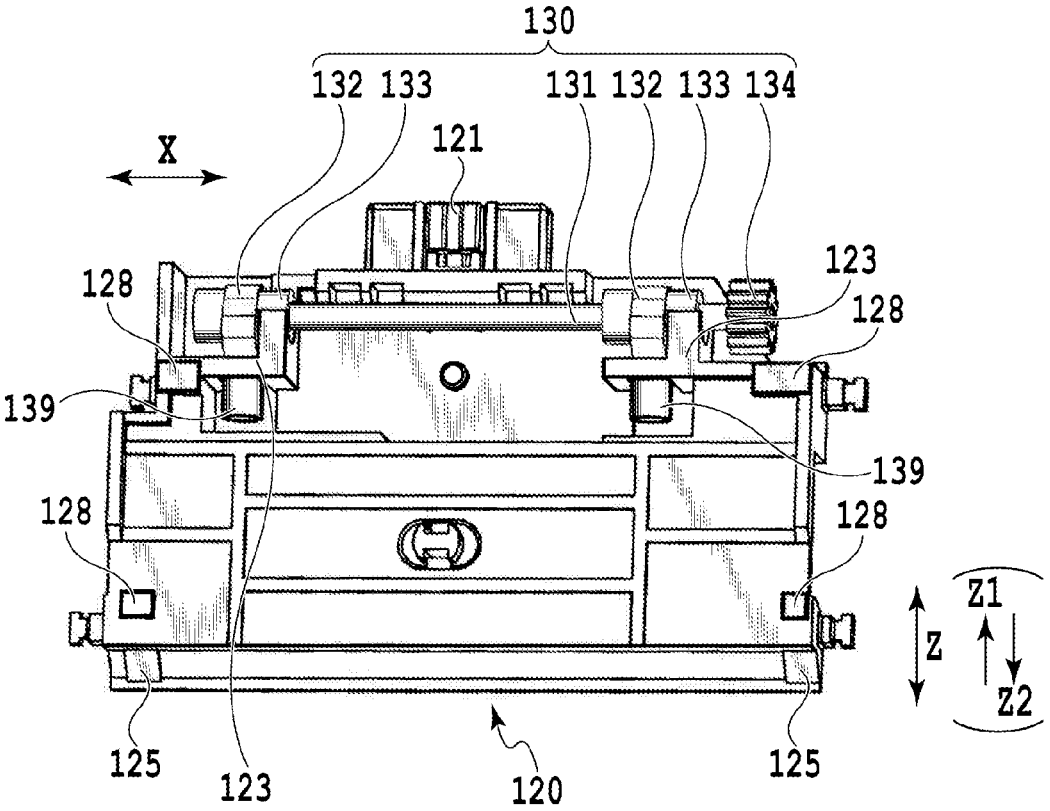
FIG. 6 is a perspective view of a second carriage structure that is a constituent of the carriage unit.

FIG. 3 is a perspective view of the carriage unit 100, on which the print head 200 and the ink tank 300 are not yet mounted, and FIG. 4 is a perspective view of the carriage unit 100, on which the print head 200 and the ink tank 300 are mounted. FIG. 5 is a rear perspective view of the first carriage structure 110, and FIG. 6 is a perspective view of the second carriage structure 120.

As described above, the carriage unit 100 includes the first carriage structure 110 that serves as the primary structure and the second carriage structure 120 that serves as the secondary structure coupled with the rear side of the first carriage structure 110. As shown in FIG. 3, the first carriage structure 110 has a print head receiving portion 111 to receive and position the print head 200 in the first carriage structure 110. Further, the first carriage structure 110 includes a carriage cover 160, used to guide the print head 200 to be mounted, and the head fixing portion 140 used to push down and fix the print head 200 at a predetermined location of the first carriage structure 110. Furthermore, as shown in FIG. 5, positioning protrusions 113 that are to be fit to the engagement portions 203 of the print head 200 used for print head positing are formed on both the lower right and left portions of the first carriage structure 110. An X-directional abutting face is formed only on one side of each positioning protrusion 113, and a Y abutting face used for positioning in the Y direction (the conveying direction) and a Z abutting face used for positioning in the Z direction are formed on both lower sides of each positioning protrusion 113.

Moreover, a print head setting lever 145 is arranged for the first carriage structure 110, and serves as a manipulation portion used by the user of the printing apparatus to pivot the head fixing portion 140. The print head setting lever 145 is rotatable in a direction indicated by an arrow A1 or A2 at a lever rotation shaft 146 (see FIG. 5) that is provided for the first carriage structure 110, and the head fixing portion 140 is open or closed in conjunction with the rotation of the print head setting lever 145. When the print head setting lever 145 is rotated in the direction of the arrow A1, the head fixing portion 140 pivots at a rotary shaft 141 (see FIG. 7) and is closed. A print head fixing cam arranged for the print head fixing portion 140 is brought in contact with the sloped pressing face 207 of the upper portion of the print head 200, the pressing force of a print head fixing spring is applied to the print had 200 through the print head fixing cam, and as a result, the print head 200 is positioned in the first carriage structure 110. In this manner, the print head 200 abuts upon the first carriage structure 110 and is held in position.

More specifically, the Z abutting faces of the engagement portions 203 for print head positioning are pressed against the Z-directional positioning faces of the positioning protrusions 113 of the first carriage structure 110. Further, the Y abutting faces of the engagement portions 203 for print head positioning are brought in contact with the Y-directional positioning faces prepared near the Z-directional positioning faces of the positioning protrusions 113 of the first carriage structure 110. Moreover, the X abutting faces of the engagement portions 203 for print head positioning are pressed against the X-directional positioning faces of the positioning protrusions 113 of the first carriage structure 110. Also, the Y-directional sub abutting face (not shown) prepared in the upper portion of the print head 200 is pressed against the Y-directional sub positioning face at the distal end of a protrusion that is formed near the center of the first carriage structure 110. When these faces are pressed against each other, the print head 200 can be appropriately and accurately mounted on and positioned at a predetermined mounting location of the print head receiving portion 111 of the first carriage structure 110.

As shown in FIG. 5, first sliding faces (vertical faces in the gravitational direction) 115 that are perpendicular to the conveying direction (Y direction) and parallel to the main scanning direction (X direction) are formed at the lower portion of the rear face of the first carriage structure 110. The first sliding faces 115 contact the guide shaft 11 and slide in the main scanning direction. Further, on the rear face of the first carriage structure 110, first unit holding faces 118 that are perpendicular to the conveying direction (Y direction) and parallel to the main scanning direction (X direction) are formed at locations opposite the second carriage structure 120. Whereas, second sliding faces (sloped faces) 125 that are inclined relative to the first sliding faces (vertical faces) 115, and contact the guide shaft 11 and slide in the main scanning direction are prepared at the locations of the second carriage structure 120 opposite the first sliding faces 115. Further, second unit holding faces 128 that are perpendicular to the conveying direction (Y direction) and parallel to the main scanning direction (X direction) are prepared at the locations of the second carriage structure 120 opposite the first unit holding faces 118 of the first carriage structure 110. That is, the first sliding faces 115 contact the side of the guide shaft 11 having a circular cross section, while the second sliding faces 125 are sloped faces inclined in the gravitational direction, and contact the obliquely upper portion of the circular guide shaft 11.

Figure 7:
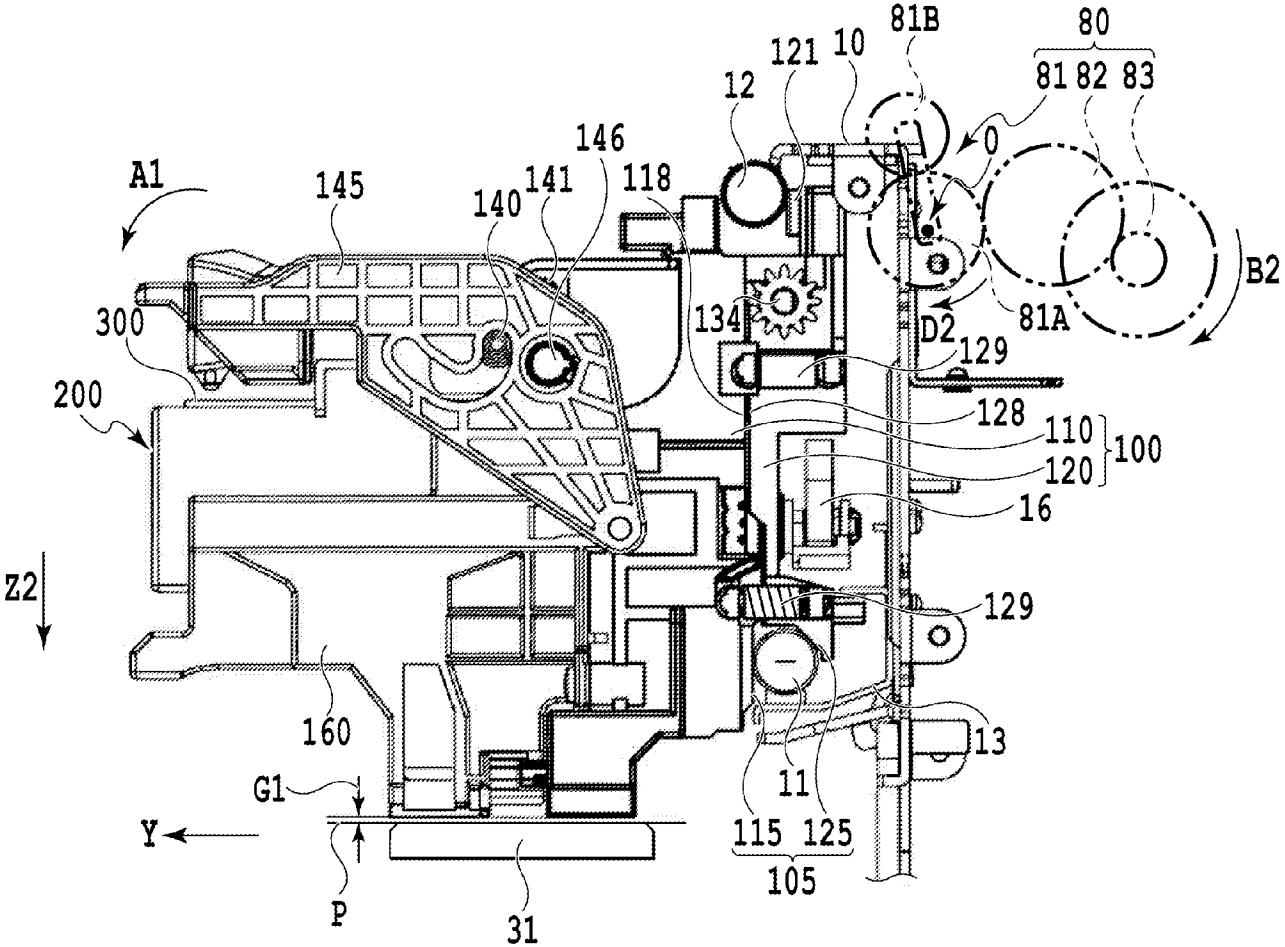
FIG. 7 is a side view of a carriage lift mechanism when the first carriage structure is located at a first gap position.

FIG. 7 is a side view of the carriage unit 100, and a spring (rear spring) 129 that is an elastic member to push the first carriage structure 110 and the second carriage structure 120 in a direction in which these structures 110 and 120 approach each other is provided between the first carriage structure 110 and the second carriage structure 120. Since the first unit holding faces 118 of the first carriage structure 110 and the second unit holding faces 128 of the second carriage structure 120 always contact each other by the urging force of the rear spring 129, the carriage unit 100 is obtained. The second carriage structure 120 holds the first carriage structure 110, so that the position of the first carriage structure 110 can be adjusted in the direction of the arrow Z (Z1 or Z2).

(Structure of the Bearing)

The first sliding faces 115 provided for the first carriage structure 110 and the second sliding faces 125 provided for the second carriage structure 120 constitute the bearings 105 of the carriage unit 100 that are located with respect to the guide shaft 11. When the first unit holding faces 118 of the first carriage structure 110 and the second unit holding faces 128 of the second carriage structure 120 always contact with each other, the stable posture of the carriage 100 is maintained. While maintaining the contact of the first and second unit holding faces 118 and 128, the first carriage structure 110 and the second carriage structure 120 are displaced relative to each other in the direction of the arrow Z (Z1 or Z2). Because of this displacement, the relative positions of the first and second sliding faces 115 and 125 that constitute the bearings 105 are changed. The first and second sliding faces 115 and 125 form a so-called inverted V-shape bearing face. As a result, the bearings 105 wherein the first and second sliding faces 115 and 125 contact the guide shaft 11 are provided at the lower portion of the carriage unit 100 to clamp the guide shaft 11. In other words, the individual bearings 105 are provided by employing the first sliding faces 115 of the first carriage structure 110 and the second sliding faces 125 of the second carriage structure 120.

The bearings 105 contact the guide shaft 11 from above by simply receiving the weight of the carriage unit 100. The first sliding faces 115 of the first carriage structure 110 and the second sliding faces 125 of the second carriage structure 120 contact the outer peripheral surface of the guide shaft 11 to clamp the guide shaft 11 between these sliding faces 115 and 125. The first sliding faces 115 are extended in the gravitational direction (vertical direction) of the arrow Z, as shown in FIG. 7, and hold the carriage unit 100 at the accurate position in the conveying direction (Y direction). Further, positioning of the carriage unit 100 in the direction of the arrow Z is performed mainly by bringing the second sliding faces 125 in contact with the guide shaft 11. Furthermore, when an upper slider 121 provided for the second carriage structure 120 contacts the support rail 12, the rotation of the carriage unit 100 at the guide shaft 11 is controlled to maintain the stable posture of the carriage unit 100. Regardless of the gap position of the first carriage 110, the location where the second sliding faces 125 of the second carriage structure 120 contact the guide shaft 11 and the location where the upper slider 121 of the second carriage structure 120 contacts the support rail 12 are fixed.

When the bearings 105 are brought in contact with the guide shaft 11 by simply applying the weight of the carriage unit 100, the carriage unit 100 can be moved in the main scanning direction, while being stably and accurately held in position. Therefore, a special impelling mechanism employing, for example, an impelling spring is not required to bring the bearings 105 in contact with the guide shaft 11. Furthermore, a sliding load imposed between the bearings 105 and the guide shaft 11 can be reduced to minimize abrasions at the locations (line contact points) where these components contact, and the durability of the components can be improved.

The first carriage structure 110 directly positions the print head 200 by engaging the positioning protrusions 113 and the engagement portions 203 used for positioning the print head 200. Further, when the first sliding faces 115 of the first carriage structure 110 are brought in contact with the guide shaft 11, the first carriage structure 110 can be immediately positioned with respect to the guide shaft 11, and can slide in the main scanning direction. The first carriage structure 110 that is one of the parts provides the portions (positioning protrusions 113) that hold the print head 200 in position and the portions (first sliding faces 115) that contact the guide shaft 11 to hold the first carriage unit 110 in position. Therefore, compared with a case wherein these portions are provided by using two different parts, a tolerance of the two parts can be excluded, therefore the positioning accuracy for the print head 200 with respect to the guide shaft 11 can be increased, and the quality of the image printed on the print sheet P can be improved.

(Structure of the Guide Shaft)

The guide shaft 11 is fixed to the chassis 10 at the two ends in order to reciprocally guide the carriage unit 100 in the main scanning direction of the arrow X. The ends of the guide shaft 11 are fixed to a shaft fixing stay 13 that is made of a sheet metal, and the shaft fixing stay 13 is attached to the chassis 10 to provide the fixed center location of the guide shaft 11. The guide shaft 11 and the shaft fixing stay 13 are fastened by five screws (not shown) at almost equal intervals, while the shaft fixing stay 13 fastened to the guide shaft 11 and the chassis 10 are fastened by five screws (not shown) at almost equal intervals.

(Structure of a Carriage Lift Mechanism)

A carriage lift mechanism (gap changing mechanism) is driven by the lift driver 80 to move the first carriage structure 110 in the vertical directions of the arrow Z. In accordance with this movement, a distance (gap) between the ejection portions 201 of the print head 200 and the print sheet P is changed.

As shown in FIG. 6, the second carriage structure 120 includes a lift cam unit 130 to change the gap. The lift cam unit 130 includes a lift shaft 131 made of metal and eccentric cams (lift cams) 132 fitted over the lift shaft 131 at the right and left ends. A lift gear 134 is fitted to the end of the lift shaft 131 outside one of the eccentric cams 132. Lift shaft sliders 133 are pivotally supported by cam supporting portions 123 prepared for the second carriage structure 120, and the cam supporting portions 123 are impelled by lift impelling springs 139 in the direction of the arrow Z1. That is, the lift cam unit 130 is impelled through the cam supporting portions 123 by the lift impelling springs 139 in the direction of the arrow Z1. With this arrangement, as will be described later, the outer peripheral surfaces of the eccentric cams 132 are pressed against cam followers 117 (see FIG. 5) provided on the top face of the first carriage structure 110.

For performing printing on, for example, a thick print sheet P, the lift cam unit 130 increases the gap to protect the print head 200 from contact the print sheet P. An explanation will be given for the arrangement wherein a first gap position used to change the gap to a comparatively small gap G1 and a second gap position used to change the gap to a comparatively large gap are set.

(Operation of the Carriage Lift Mechanism)

Figure 8:
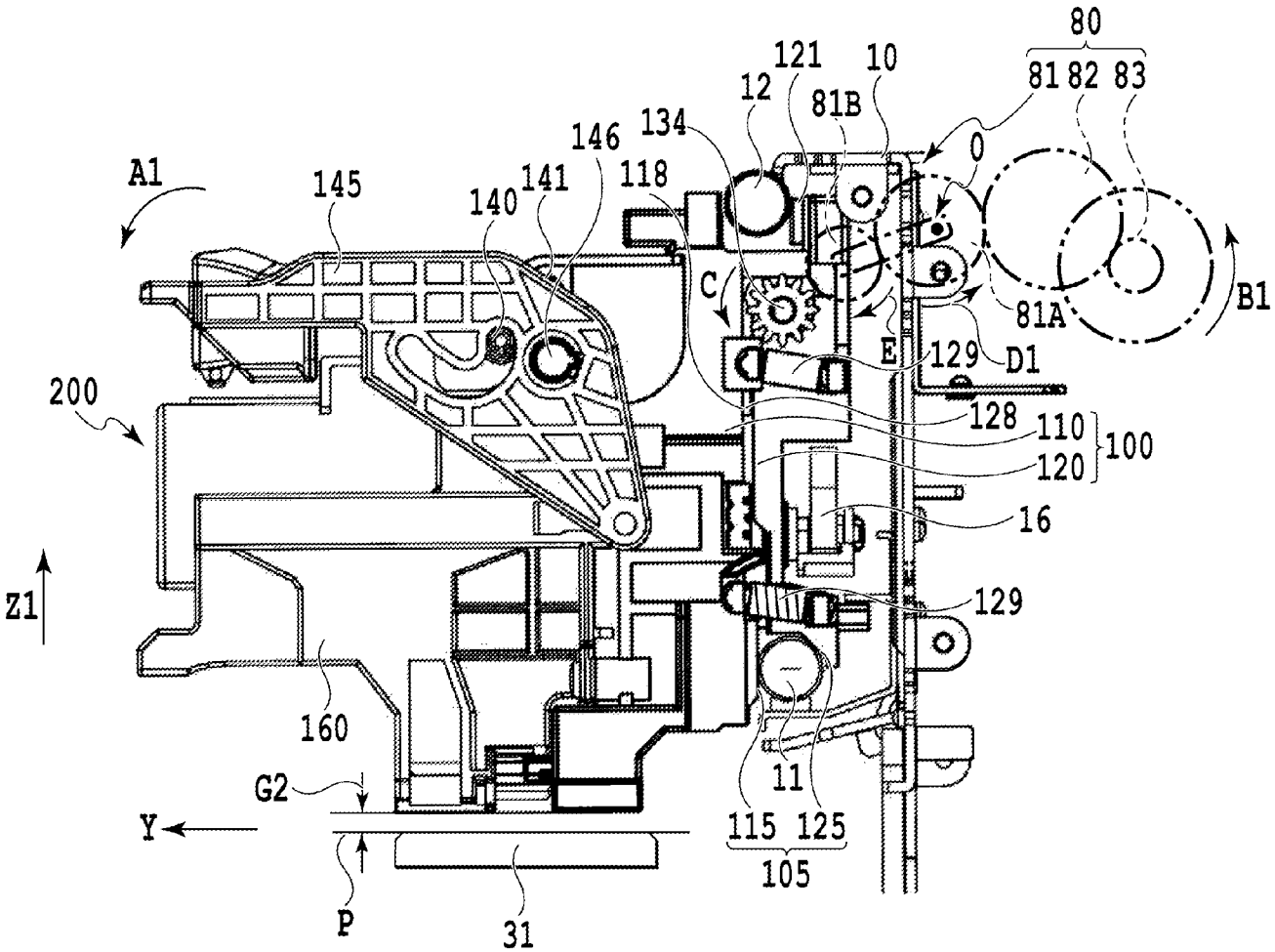
FIG. 8 is a side view of the carriage lift mechanism when the first carriage structure is located at a second gap position.
Figure 9:
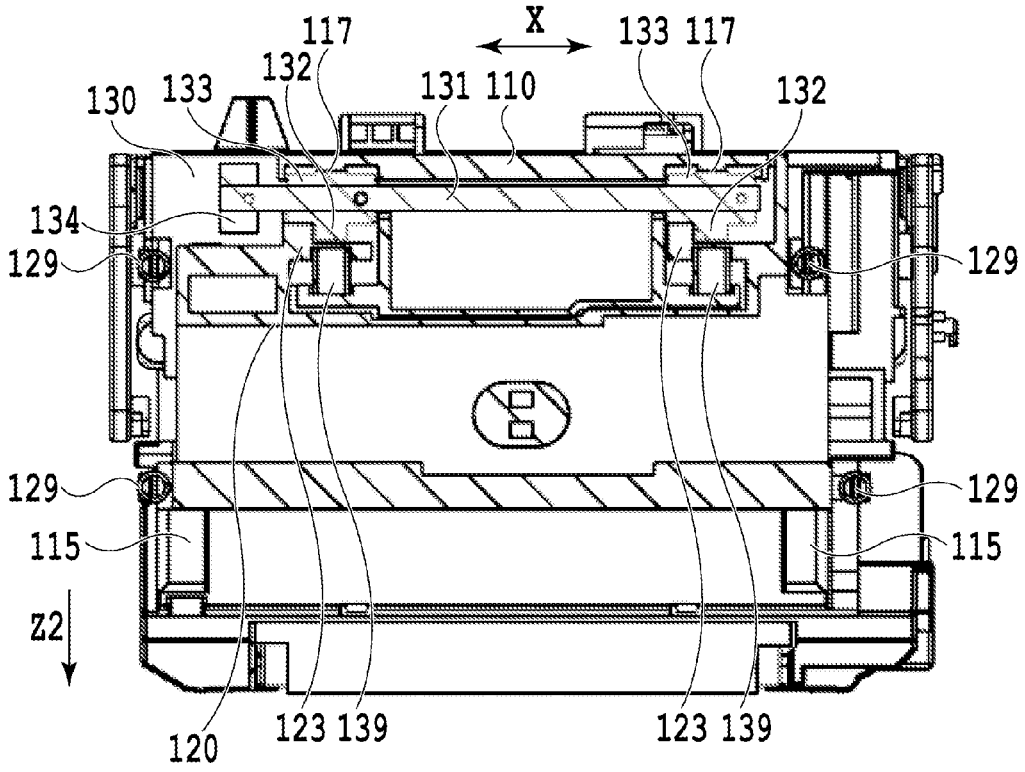
FIG. 9 is a cross-sectional view of the carriage lift mechanism when the first carriage structure is located at the first gap position.
Figure 10:
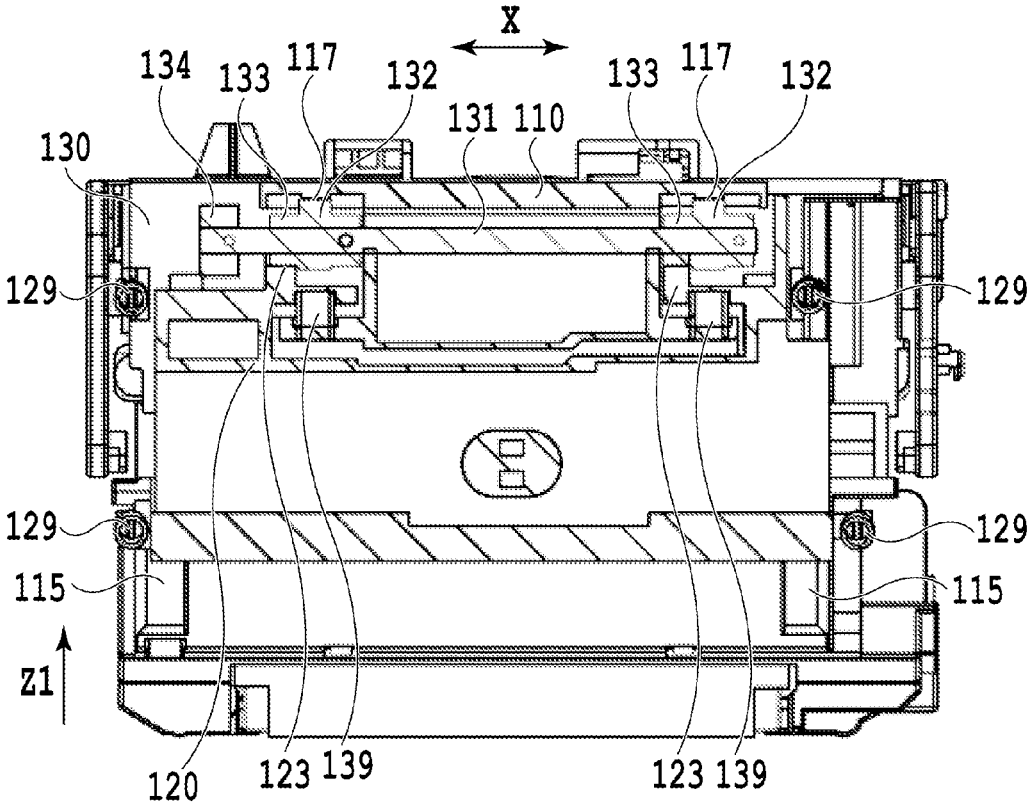
FIG. 10 is a cross-sectional view of the carriage lift mechanism when the first carriage structure is located at the second gap position.
Figure 11:
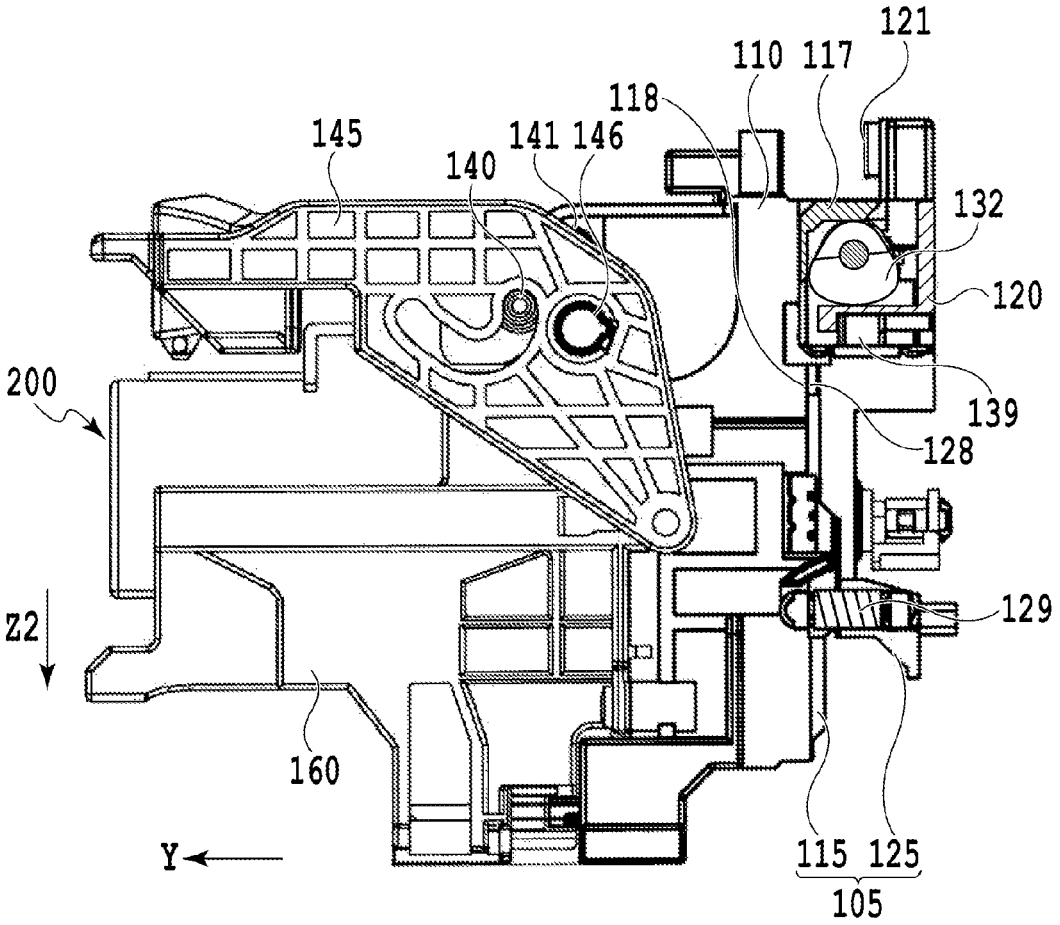
FIG. 11 is a partially cutaway side view of the carriage lift mechanism when the first carriage structure is located at the first gap position.
Figure 12:
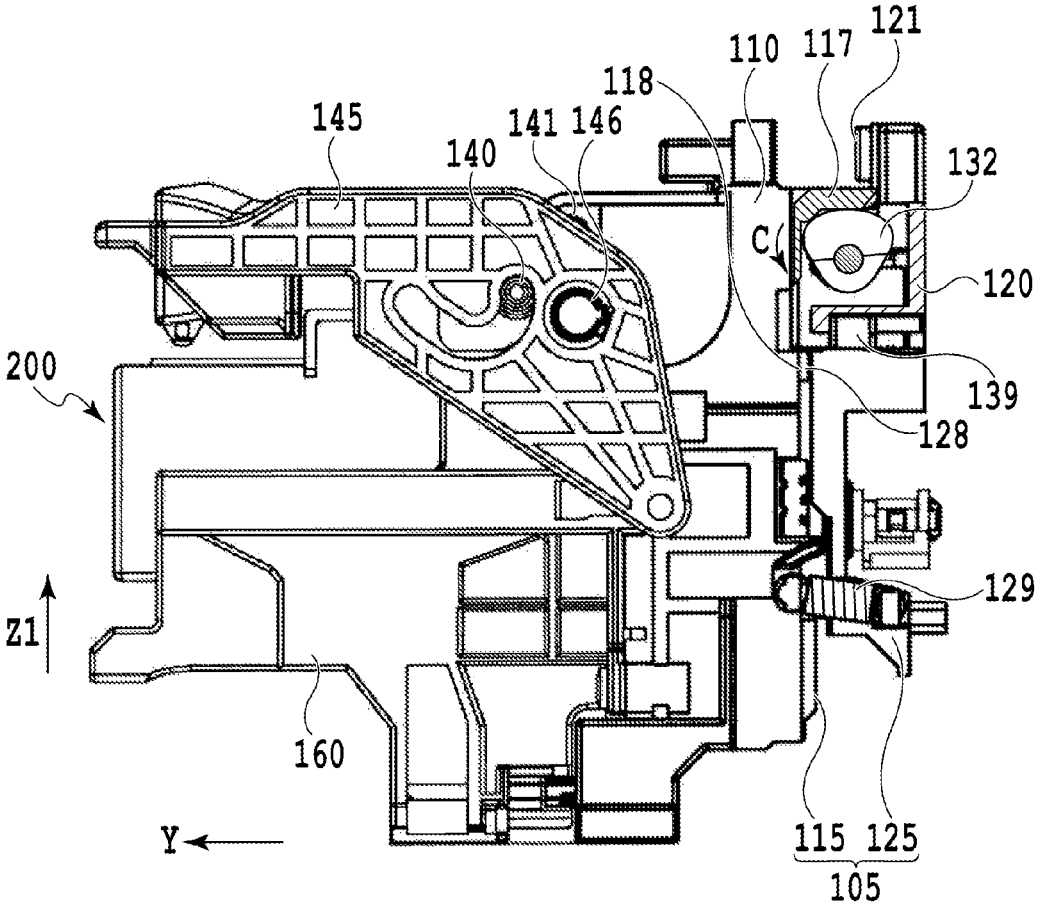
FIG. 12 is a partially cutaway side view of the carriage lift mechanism when the first carriage structure is located at the second gap position.

FIGS. 7, 9 and 11 are explanatory diagrams for a case wherein printing of images is performed at the first gap position (normal position) used to define the small gap G1. FIGS. 8, 10 and 12 are explanatory diagrams for a case wherein printing of an image is performed at the second gap position used to define the large gap G2, when the print sheet P is, for example, coated paper or a sheet made of a material that tends to be curled. FIGS. 7 and 8 are side views of the carriage unit 100 to explain the gaps G1 and G2 at the first and second gap positions. FIGS. 9 and 10 are cross-sectional views of the lift cam unit 130 of the second carriage structure 120 at the first and second gap positions. FIGS. 11 and 12 are partially cutaway side views of the carriage unit 100 at the first and second gap positions.

At the first gap position shown in FIGS. 7, 9 and 11, the cam faces of the eccentric cams 132 that are the nearest from the center of the lift shaft 131 are brought in contact with the cam followers 117 of the first carriage structure 110. At the first gap position, the comparatively small gap G1 is defined. This gap G1 is set so that a preferable printing quality can be obtained when an image is printed on a print sheet P having a standard thickness and a standard material.

In a case wherein the first gap position is to be changed to the second gap position, the lift cam unit 130 serving as a carriage lift mechanism is rotated by the lift driver 80 prepared for the chassis 10, as shown in FIG. 7. The lift driver 80 that can drive the lift cam unit 130 includes a lift motor 83 employed as a driving source, a lift idler gear 82 and a pendulum gear unit 81. The pendulum gear unit 81 includes a sun gear 81A and a planetary gear 81B, which can revolve around an axial line O of the sun gear 81A extending in the main scanning direction, and can rotate around an axial line of the planetary gear 81B.

The lift driver 80 is provided for the chassis 10, so that the lift driver 80 is located opposite the carriage lift mechanism when the carriage unit 100 has reached a predetermined scanning position. During the operation of the carriage lift mechanism, the sun gear 81A rotates in a direction of an arrow D1, as shown in FIG. 8, and accordingly, the planetary gear 81B revolves in the direction of the arrow D1, and enters a scanning area of the carriage unit 100. At the other times, the sun gear 81A is located by rotating in a direction of an arrow D2, and the planetary gear 81B is located by revolving in the direction of the arrow D2, and is retracted outside the scanning area of the carriage unit 100.

For operating the lift cam unit 130, the carriage unit 100 is halted at the predetermined scanning position opposite the lift driver 80, and as shown in FIG. 8, the lift motor 83 is rotated in a direction of an arrow B1. As a result, the sun gear 81A is rotated via the lift idler gear 82 in the direction of the arrow D1. Since the planetary gear 81B can be rotated at the axial line O with a predetermined friction force, the planetary gear 81B revolves in the direction of the arrow D1 and engages with the lift gear 134. Thus, the rotational force of the planetary gear 81B in a direction of an arrow E is transmitted to the lift gear 134, and the lift cam unit 130 is rotated, together with the lift gear 134, in a direction of an arrow C.

When the lift cam unit 130 is pivoted, as shown in FIG. 8, in the direction of the arrow Cat a predetermined angle, the cam faces of the eccentric cams 132 that are the farthest from the center of the lift shaft 131 are brought in contact with the cam followers 117 of the first carriage structure 110. As a result, the first carriage structure 110 is moved at a predetermined distance with respect to the second carriage structure 120 in a direction in which the first carriage structure 110 is separated from the print face of the print sheet P (in the upward direction (the direction of the arrow Z1) perpendicular to the print face of the print sheet P). At this time, the first and second unit holding faces 118 and 128 slide while contacting each other by the rear spring 129. Since the eccentric cams 132 are rotated in this manner, the first carriage structure 110 is moved upward (in the Z1 direction) at the predetermined distance, and is held in position by the eccentric cams 132. As a result, the location of the first carriage structure 110 is changed from the first gap position to the second gap position, and the large gap G2 is defined. Switching from the first position to the second gap position is performed in a case wherein the print sheet P may touch the print head 200 at the first gap position, e.g., in a case wherein print sheets P thicker than the normal sheets are employed.

After the first gap position is changed to the second gap position in this manner, the lift motor 83 is rotated in a direction of an arrow B2. Sequentially, the sun gear 81A is rotated through the lift idler gear 82 in the direction of the arrow D2, while the planetary gear 81B revolves in the direction of the arrow D2, and is retracted outside the scanning area of the carriage unit 100. Thereafter, the carriage unit 100 is moved in the main scanning direction to print an image on the print sheet P.

In a case wherein the position of the first carriage structure 110 is to be changed from the second gap position to the first gap position, the carriage unit 100 is halted at the predetermined scanning position opposite the lift driver 80. Then, the lift motor 83 is rotated in the direction of the arrow B1, as shown in FIG. 8. As a result, the planetary gear 81B engages the lift gear 134, and the lift cam unit 130 is pivoted at a predetermined angle in the direction of the arrow C, so that the cam faces of the eccentric cams 132 that are nearest from the center of the lift shaft 131 are brought in contact with the cam followers 117. The first carriage structure 110 is moved downward (in the Z2 direction) by the rear spring 129, with respect to the second carriage structure 120. As a result, the second gap position is changed to the first gap position, and the small gap G1 is defined. Thereafter, the lift motor 83 is rotated in the direction of the arrow B2 to retract the planetary gear 81B outside the scanning area of the carriage unit 100, and the carriage unit 100 is moved in the main scanning direction to print an image on the print sheet P.

Switching between the first and second gap positions can be automatically performed, without manipulation by the user being required, based on information associated with the print sheet P, such as information associated with the thickness of the print sheet P, that is transmitted from the host apparatus to the printing apparatus. Further, the most appropriate gap for the thickness or the type of the print sheet P can be set in accordance with the shapes and the rotational angles of the eccentric cams 132.

(Positional Relationship of the First and Second Sliding Faces)

Figure 13A:
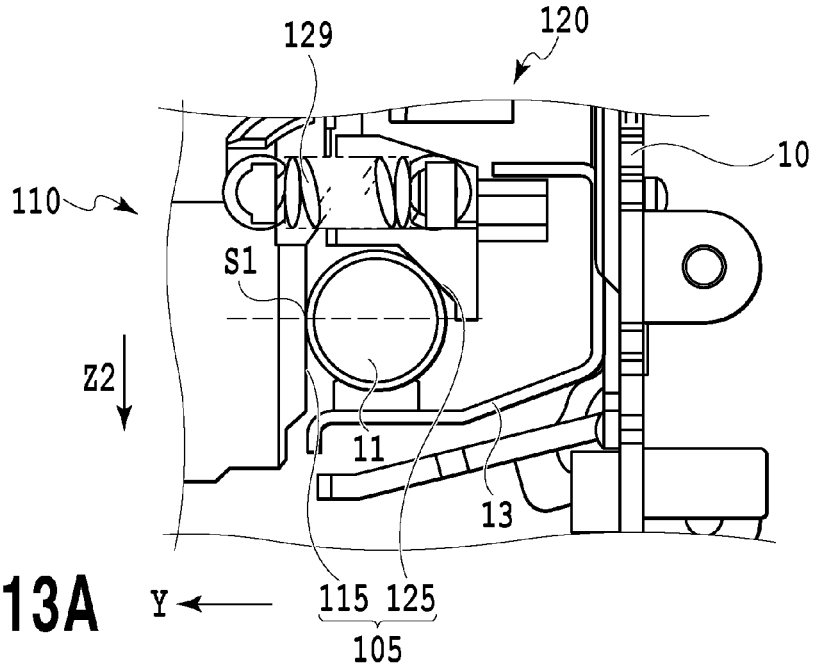
FIGS. 13A and 13B are enlarged diagrams showing an essential portion of a bearing of the carriage unit.
Figure 13B:
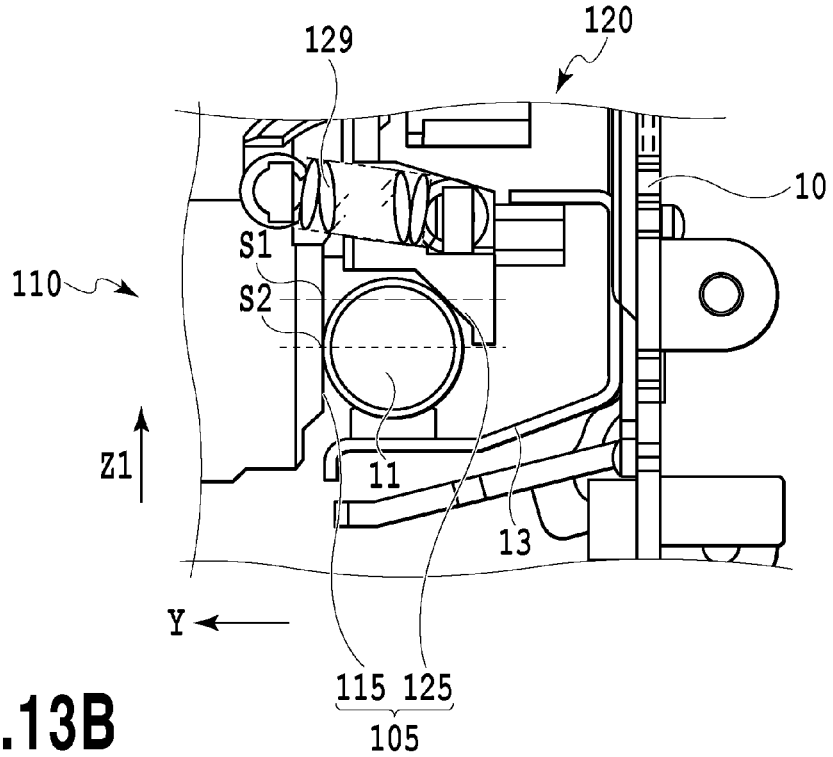
Figure 14:
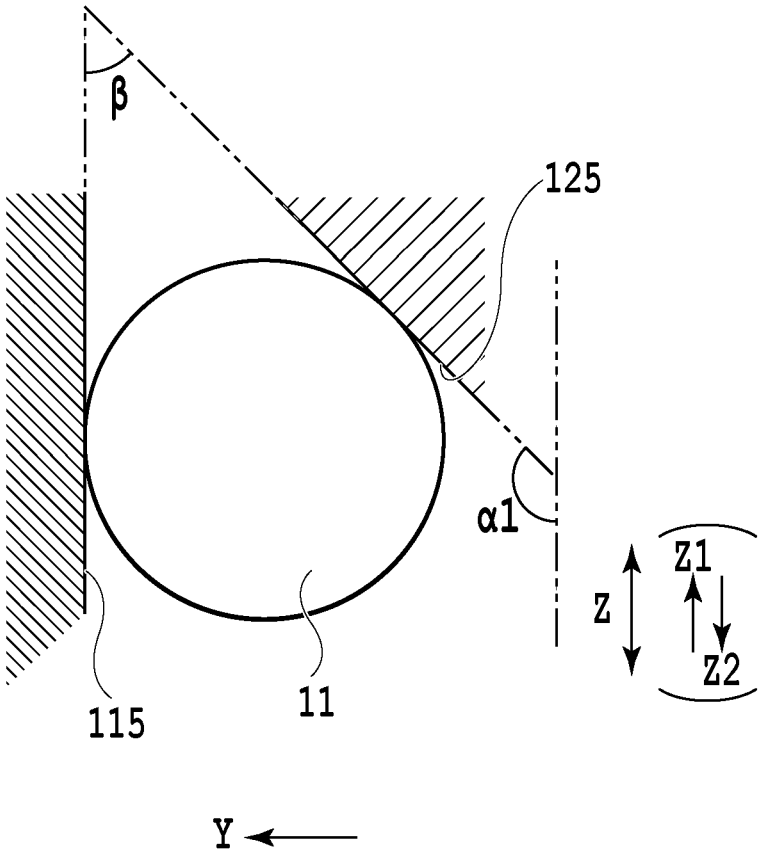
FIG. 14 is a diagram for explaining the positional relationship of first and second sliding faces.

FIGS. 13A and 13B are enlarged diagrams for explaining the bearings 105 in detail at the first gap position and at the second gap position. FIG. 14 is an explanatory diagram for the positional relationship of the first and second sliding faces 115 and 125.

As shown in FIG. 14, the first sliding faces 115 of the first carriage structure 110 are faces perpendicular to the conveying direction (the direction of the arrow Y), and parallel to the main scanning direction (the direction of the arrow X). That is, the first slicing faces 115 are extended in the direction (the Z direction), in which the first carriage structure 110 moves. The second sliding faces 125 of the second carriage structure 120 are inclined at a predetermined angle $\alpha 1$ with respect to the direction (the Z direction), in which the first carriage structure 110 moves. Since an angle $\alpha 2$ formed by the first sliding face 115 with respect to the traveling direction (the Z direction) of the first carriage structure 110 is zero degrees, $\alpha 1 > \alpha 2$ is established. An angle $\beta$ formed by the extension lines of the first and second sliding faces 115 and 125 is fixed and unchanged even when the first sliding faces 115 are moved, together with the first carriage structure 110, in the direction of the arrow Z.

In a case wherein the first carriage structure 110 is located at the first gap position as shown in FIG. 13A, the first sliding faces 115 contact the guide shaft 11 at a contact position S1, and slide in the main scanning direction. The bearings 105 accurately position the carriage unit 100, with respect to the guide shaft 11, by clamping the guide shaft 11 between the first sliding faces 115 of the first carriage structure 110 and the second sliding faces 125 of the second carriage structure 120. In a case wherein the first carriage structure 110 is located at the second gap position as shown in FIG. 13B, the first sliding faces 115 contact the guide shaft 11 at a contact position S2, which is below the contact position S1, and slide in the main scanning direction. That is, the position of the first carriage structure 110 is adjusted to shift, in the traveling direction (the Z direction) of the first carriage structure 110, the position where the first sliding faces 115 contact the guide shaft 11.

When the location of the first carriage structure 110 is adjusted, by switching the gap position, in the predetermined direction of the arrow Z1 or Z2, with respect to the second carriage structure 120, the first sliding faces 115 still contact the guide shaft 11 at the contact positions in the same plane. Therefore, even when the gap position has been changed, relative positions of the first carriage structure 110 and the second carriage structure 120 in the conveying direction (Y direction) are always fixed. Therefore, as described above, the angle $\beta$ formed by the first and second sliding faces 115 and 125 is fixed and unchanged. As a result, the bearings 105 are formed constantly in a so-called inverted V shape, regardless of the gap position.

In this embodiment, the print head 200 and the guide shaft 11 directly contact the first carriage structure 110 employed in common, and are positioned in the conveying direction (Y direction). When the first sliding faces 115 contact the guide shaft 11, the first carriage structure 110 moves upward or downward (in the Z1 or Z2 direction) in accordance with the gap position, while maintaining the same posture, and also moves in the main scanning direction (in the X direction) while maintaining the same posture. Therefore, high positioning accuracy for the print head 200 and the guide shaft 11 can be maintained, regardless of the gap position, and a high quality image can be printed on the print sheet P. Furthermore, the number of gap positions to be set is not limited to only two, and an arbitrary number of gap positions may be set.

(Modifications)

Figure 15A:
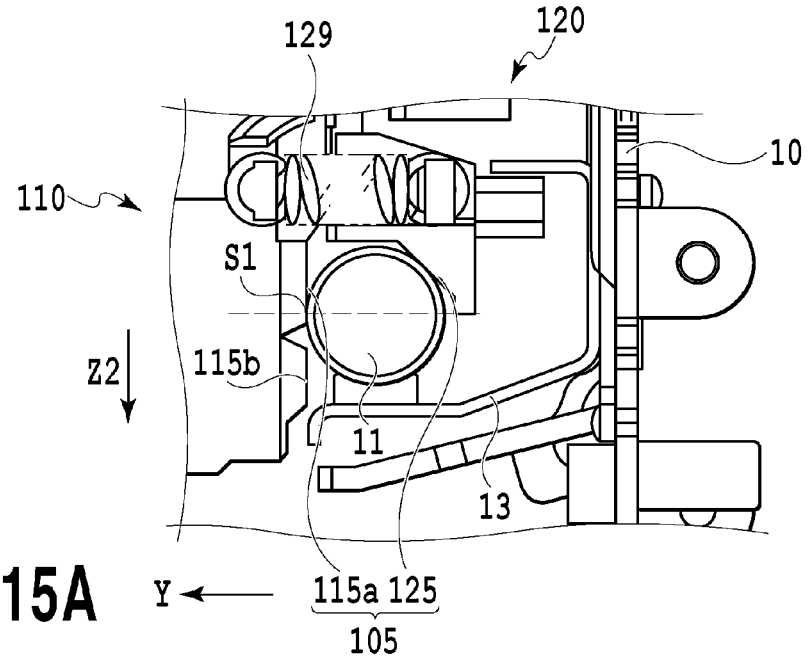
FIGS. 15A and 15B are enlarged diagrams showing an essential portion of a bearing of a carriage unit according to a modification of the present invention.
Figure 15B:
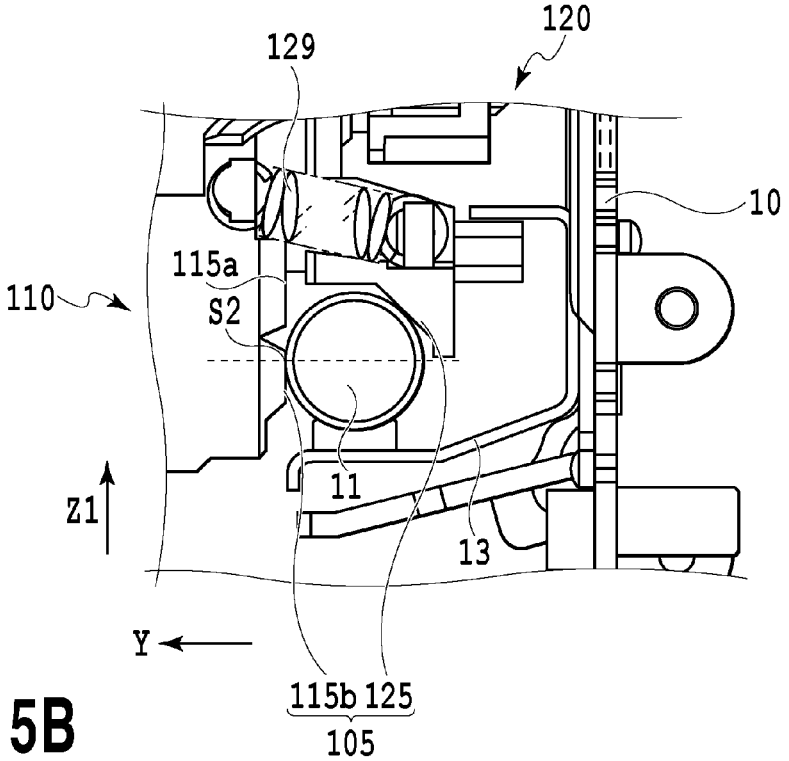

FIGS. 15A and 15B are enlarged diagrams for bearings 105 of a carriage unit 100 according to a modification of the present invention, and in this modification, a plurality of sliding faces 115 are formed on the same plane. The individual first sliding faces 115 are split into two segments, an upper portion and a lower portion, that serve as sliding faces 115*a* and 115*b*. The sliding faces 115*b* are formed below the sliding faces 115*a*, and are located on the same plane as the sliding faces 115*a*. Therefore, as well as the first sliding faces 115 of the above described embodiment, the first sliding faces 115 that each include the sliding faces 115*a* and 115*b* provide the plane that is perpendicular to the conveying direction (the direction of the arrow Y), and is parallel to the main scanning direction.

When the first carriage structure 110 is located at the first gap position, the upper sliding faces 115*a* contact the guide shaft 11 at a contact point S1, and the slides along the guide shaft 11, as shown in FIG. 15A. When the first carriage structure 110 is moved in the direction of the arrow Z1 with respect to the second carriage structure 120, as shown in FIG. 15B, the first carriage structure 110 reaches the second gap position. At the second gap position, the lower sliding faces 115*b* contact the guide shaft 11 at a contact position S2, and slide along the guide shaft 11.

As described above, so long as the first sliding faces 115 are located on the same plane of the first carriage structure 110 that serves as the primary structure, the first sliding faces 115 may be provided in an arbitrary manner, and may be divided into a plurality of segments as in the modification. The number of segments of the first sliding faces 115 is not limited to two as in this modification, and the number of segments that corresponds to the number of gap positions to be set may be employed.

Figure 16A:
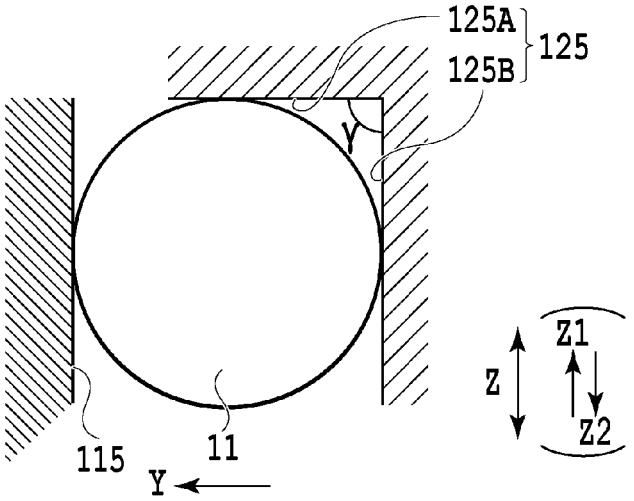
FIGS. 16A, 16B and 16C are diagrams for explaining other examples showing different positional relationships of the first and second sliding faces.
Figure 16B:
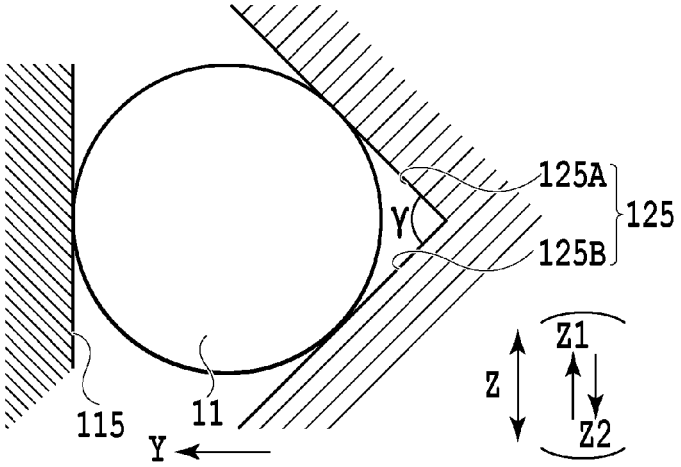

The arrangement for the first and second sliding faces 115 and 125 is not limited to that shown in the embodiment, and the arrangement shown in FIG. 16A or 16B, for example, may also be employed. The second sliding faces 125 in FIG. 16A each include two sliding faces 125A and 125B that form a predetermined angle γ, and the sliding face 125B is extended upward or downward (in the Z1 or Z2 direction). In a case wherein the angle γ is 90 degrees, the other sliding face 125A is extended in the conveying direction (Y direction). The second sliding faces 125 in FIG. 16B each include two sliding faces 125A and 125B that form a predetermined angle γ, and these sliding faces 125A and 125B are extended in directions crossing to the conveying direction (Y direction).

Figure 16C:
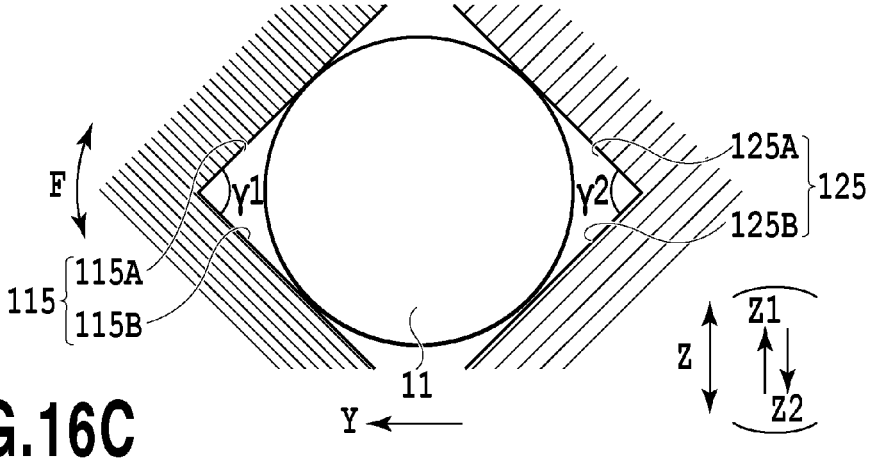

The direction in which the distance (gap) between the print head 200 and the print sheet P is to be adjusted is not limited to the vertical direction, and an arbitrary direction can be set. Further, the direction in which the first carriage structure 110 moves with respect to the second carriage structure 120 is not limited to the direction for adjusting the gap, but may be another direction. For example, when the first and second sliding faces 115 and 125 are formed in the manner as shown in FIG. 16C, the position of the first carriage 110 can be adjusted in a direction of an arrow F for rotation at the central axis of the guide shaft 11. Referring to FIG. 16C, the first sliding faces 115 each include two sliding faces 115A and 115B that form a predetermined angle γ1, and the second sliding faces 125 each include two sliding faces 125A and 125B that form a predetermined angle γ2. The angles γ1 and γ2 may be the same (number of) degrees, or different (number of) degrees.

The number of gap positions to be set is not limited to only two, and may be three or more, and further, the gap positions may be set in a stepless manner. Further, the shape of the guide shaft 11 in cross section is not limited to only a circular shape, and an arbitrary shape may be employed, so long as the movement of the first carriage structure 110 is allowed.

In the above embodiment, the carriage lift mechanism that is driven by the lift motor 83 has been described as an example. However, a carriage lift mechanism that is manually operated by manipulation of, for example, a lever by a user may be employed, and in this case, the same effects can also be obtained. The arrangement of the carriage lift mechanism is not limited to the arrangement wherein the lift cam unit 130 moves the first carriage structure 110, and another arrangement may be employed. As an example arrangement, a slide member that can slide in the main scanning direction may be provided between the first carriage structure 110 and the second carriage structure 120, and the slide member may include a portion, for which the vertical thickness is changed, step by step, or steplessly, in the main scanning direction. For this carriage lift mechanism, the first carriage structure 110 can be moved in the vertical direction, with respect to the second carriage structure 120, in a multistep manner, or in a stepless manner. Further, a rack extended vertically may be prepared for one of the first carriage structure 110 and the second carriage structure 120, and a pinion that engages the rack may be prepared for the other carriage structure. Such a carriage lift mechanism can vertically move the first carriage structure 110, with respect to the second carriage structure 120, in accordance with the rotation of the pinion.

The print head 200 mounted on the first carriage structure 110 may be provided as a separate unit from the ink tank 300, or may constitute an ink jet cartridge integrated with the ink tank 300. Further, the present invention is not limited to an ink jet printing apparatus, and can be widely applied to printing apparatuses of various printing types. Furthermore, the present invention can constitute a position adjustment mechanism that adjusts the position of the print head.

Moreover, the present invention is not limited to a printing apparatus, but can be applied to a scanning device that reads an image or information printed on a sheet, while scanning the sheet by employing a scanning head (an image sensor unit) mounted on a carriage. That is, the feature of the present invention is the construction of the carriage assembly that moves while holding the head (a print head or a scanning head), and may employ a mode in which printing of an image is performed by a print head, while the carriage is moved relative to the sheet, or a mode in which scanning of an image is performed by a scanning head, while the carriage is moved relative to the sheet.

An embodiment of the present invention provides a mechanism that improves accuracy for positioning a head relative to a carriage, and easily performs positional adjustment for the head. A carriage unit (100) includes a first carriage structure (110) and a second carriage structure (120). The first carriage structure (110) includes a first sliding face (115) that can slide along a guide shaft (11), and a head (100) can be mounted on the first carriage structure (110). The second carriage structure (120) includes a second sliding face (125) that can slide along the guide shaft (11), and can hold the first carriage structure (110) to allow positional adjustment for the first carriage structure (110) in a predetermined direction in which a position where the first sliding face (115) contacts the guide shaft (11) is to be shifted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-119640, filed Jun. 10, 2014, which is hereby incorporated by reference wherein in its entirety.

What is claimed is:

1. A carriage apparatus moveable with respect to a sheet along a guide shaft which has a circular shape in a cross section, comprising:

a first structure, which includes a first sliding face that contacts the guide shaft, and on which a head is to be mounted, and a second structure, which includes a second sliding face that contacts the guide shaft, and which holds the first structure to allow positional adjustment of the first structure relative to the second structure, wherein a portion of the first sliding face that contacts the guide shaft is shifted by performing the positional adjustment to adjust a gap between the head and a surface of the sheet, and wherein the first sliding face has a vertical face that is parallel to a direction perpendicular to the surface of the sheet and contacts a side of the guide shaft, while the second sliding face has a sloped face that is inclined relative to the surface of the sheet and contacts an upper portion of the guide shaft.

2. The carriage apparatus according to claim 1, wherein the second structure further comprises a slider that contacts a support rail provided in parallel with the guide shaft, and wherein a portion of the second sliding face that contacts the guide shaft and a portion of the slider that contacts the supporting rail remain fixed when performing the positional adjustment.

3. The carriage apparatus according to claim 2, wherein the first sliding face is extended in the vertical direction, and the second sliding face is extended in a direction crossing the vertical direction.

4. The carriage apparatus according to claim 3, wherein a plurality of the first sliding faces are formed on a plane extended in the vertical direction.

5. The carriage apparatus according to claim 1, wherein an angle formed by the first sliding face and the second sliding face is constant, regardless of the positional adjustment of the first structure.

6. The carriage apparatus according to claim 1, wherein a force to move the carriage apparatus along the guide shaft is applied to the second structure.

7. The carriage apparatus according to claim 1, further comprising a drive unit that includes a gear or a cam to linearly slide the first structure relative to the second structure in the direction.

8. The carriage apparatus according to claim 7, wherein when the carriage assembly has moved and reached a predetermined location, a force generated by a drive source that is not provided on the carriage apparatus is transmitted to the drive unit to linearly slide the first structure.

9. The carriage apparatus according to claim 7, further comprising an elastic member arranged to prevent the first structure and the second structure being separated from each other during the linearly sliding.

10. An apparatus comprising:

a carriage apparatus according to claim 1; and a conveying unit configured to convey the sheet, for which the head performs printing or scanning, in a direction crossing a direction in which the carriage apparatus moves.

* * * * *